US006755035B1

(12) United States Patent
McNamara et al.

(10) Patent No.: US 6,755,035 B1
(45) Date of Patent: Jun. 29, 2004

(54) HVAC SYSTEM AND METHOD FOR CONDITIONING AIR

(75) Inventors: Patrick J. McNamara, Kernersville, NC (US); William E. Clark, Moscow, NC (US)

(73) Assignee: Supermarket Environment Services Company, Kernersville, NC (US)

( * ) Notice: Subject to any disclaimer, the term of this patent is extended or adjusted under 35 U.S.C. 154(b) by 0 days.

(21) Appl. No.: 10/370,903

(22) Filed: Feb. 20, 2003

(51) Int. Cl.[7] ..... F25B 7/00; B01F 3/02

(52) U.S. Cl. ..... 62/175; 62/176.6; 165/230; 236/44 A

(58) Field of Search ..... 62/176.6, 175, 62/93; 236/1 EA, 44 C, 44 A; 165/230

(56) References Cited

U.S. PATENT DOCUMENTS 4,103,508 A * 8/1978 Apple ..... 62/92
4,535,602 A * 8/1985 Alsenz ..... 62/175
5,309,725 A * 5/1994 Cayce ..... 62/90

* cited by examiner

*Primary Examiner*—William Wayner

(57) ABSTRACT

Outside air is treated to remove moisture before it enters the conditioned air space of a store or other building containing refrigeration furniture. The sensible air temperature and relative humidity measurements are taken to allow microprocessor calculations of the wet bulb temperature. A pair of unequal sized compressors of the HVAC system are then cycled in stages for peak efficiency and minimum compressor horsepower usage for low cost operation and minimal energy consumption both of the HVAC system and the refrigeration furniture. The wet bulb temperature is converged by the microprocessor which iterates a known polynomial approximately every 6 seconds to derive the wet bulb temperature. A time delay circuitry set at approximately 30 minutes prevents unnecessary staging of the compressors.

20 Claims, 3 Drawing Sheets

HVAC SYSTEM AND METHOD FOR CONDITIONING AIR

FIELD OF THE INVENTION

The invention herein pertains to conditioning air for a building and particularly pertains to removing moisture from the outside air to improve the efficiency of refrigeration systems therein.

DESCRIPTION OF THE PRIOR ART AND OBJECTIVES OF THE INVENTION

Fresh outside air brought into a building through the HVAC system contains moisture which impacts the efficiency and expense of operating internal refrigeration systems (refrigeration furniture such as food display cases and the like). While such efficiency loss and operational expense may be nominal in homes or small offices, in larger commercial establishments moisture can severely impact refrigeration furniture and greatly increase the operational cost in a relatively short period of time. This is particularly true in businesses such as shops and stores which require relatively high tonnage HVAC systems such as in a typical grocery store of 38,000 square feet, having a 50–60 tonnage HVAC system operating under standard conditions.

An HVAC system must provide a comfortable environment for the workers and shoppers and ideally would prevent problems from occurring with refrigeration furniture such as medium temperature (0°–32° F.) open display cases containing meat or produce and low temperature (0° F. or below) closed cases which accommodate frozen foods. As all refrigeration furniture utilizes evaporator coils, such coils can "freeze" or form ice on the outside surfaces due to the humidity present. When a coil is "frozen", the refrigeration circuit is ineffective and may result in the goods thawing or spoiling. Even in instances where the goods are not severely damaged, the operation of the refrigeration furniture is lessened, causing high power consumption and increased expense as it operates.

Thus, in view of the problems and expenses which can occur with improper moisture levels in the conditioned air space in buildings such as grocery stores, the present invention was conceived and one of its objectives is to provide an apparatus and method for conditioning entering outside air of the HVAC system to allow optimum efficiency of the internal refrigeration system;

It is another objective of the present invention to provide a method for staging the compressors of the HVAC systems according to the wet bulb temperature of the outside air as it enters the HVAC system;

It is still another objective of the present invention to measure the sensible temperature of the outside air with an electronic temperature measuring sensor and to measure the relative humidity by a conventional electronic sensor before said air enters the conditioned air space;

It is yet another objective of the present invention to calculate the wet bulb temperature from the sensible air temperature and the relative humidity, utilizing a microprocessor;

It is a further objective of the present invention to stage the HVAC compressors according to the calculations of the wet bulb temperature and to compare the wet bulb temperature to preselected wet bulb set points of the compressor(s) capacity (such as by MBH and/or horsepower) whereby the moisture in the conditioned air is reduced so that the refrigeration furniture within the building operates efficiently (such as with their evaporator coils free of frost and ice);

It is yet a further objective of the present invention to provide an HVAC system having a pair of unequal capacity compressors which operate within four stages for maximum efficiency and the least amount of HVAC horsepower utilized.

Various other objectives and advantages of the present invention will become apparent to those skilled in the art as a more detailed description is set forth below.

SUMMARY OF THE INVENTION

The aforesaid objectives are achieved by providing an HVAC system for a grocery store or other building to monitor and closely control the moisture in the conditioned air space. Treating the outside air in the method disclosed provides optimum efficiency of the internal refrigeration systems such as for example, refrigeration furniture cases as follows:

Step 1: The sensible temperature of the outside air is measured by a conventional electronic sensor before it enters the conditioned air space;

Step 2: The relative humidity of the outside air is measured by a conventional electronic sensor before it enters the conditioned air space;

Step 3: The wet bulb temperature is calculated from the sensible air temperature and the relative humidity measurement by a microprocessor which converges the wet bulb temperature by calculating a known polynomial; and Step 4: Unequal size (horsepower) compressors are staged according to the calculations of the microprocessor to remove moisture from the outside air before it enters the conditioned air space.

The two measured points (sensible air temperature and relative humidity) are used to calculate the wet bulb temperature of the incoming air. The wet bulb temperature is compared to preselected set points of the HVAC compressors which in turn remove the moisture from the air passing through the HVAC cooling coils. The set points of the compressors are compared to the wet bulb temperature calculated by a microprocessor using the measured sensible temperature and relative humidity so that the evaporator coils of the HVAC condensing unit remove maximum moisture from the outside air, thus preventing the cooling coils of the refrigerant furniture from freezing.

The HVAC unequal size compressors are staged as follows:

Stage 1) both compressors off;

Stage 2) the smaller compressor on and the larger off;

Stage 3) the smaller compressor off and the larger on; and

Stage 4) both compressors on.

This staging or compressor control maximizes the moisture removal from the outside air before it is brought into the conditioned air space, allowing peak efficiency of the refrigeration furniture cases with the least amount of HVAC (compression) horsepower expended for a minimum energy consumption. For example, in stage 2 the smaller compressor which may be a 7½ horsepower compressor would operate while the larger, 15 horsepower compressor does not. Any wet bulb temperature below 57.2° F. would freeze the evaporator coils of the HVAC systems so any wet bulb temperature above that set point (57.2° F.) would activate stage 2, creating a minimum suction temperature of 32° F. If the wet bulb temperature increases, the microprocessor will cycle the compressors on and off into the four stages as required. A time delay circuitry (set at 30 minutes) is employed whereby the staging will not be subjected to radical staging changes.

DETAILED DESCRIPTION OF THE PREFERRED EMBODIMENTS AND OPERATION OF THE INVENTION

Figure 1:
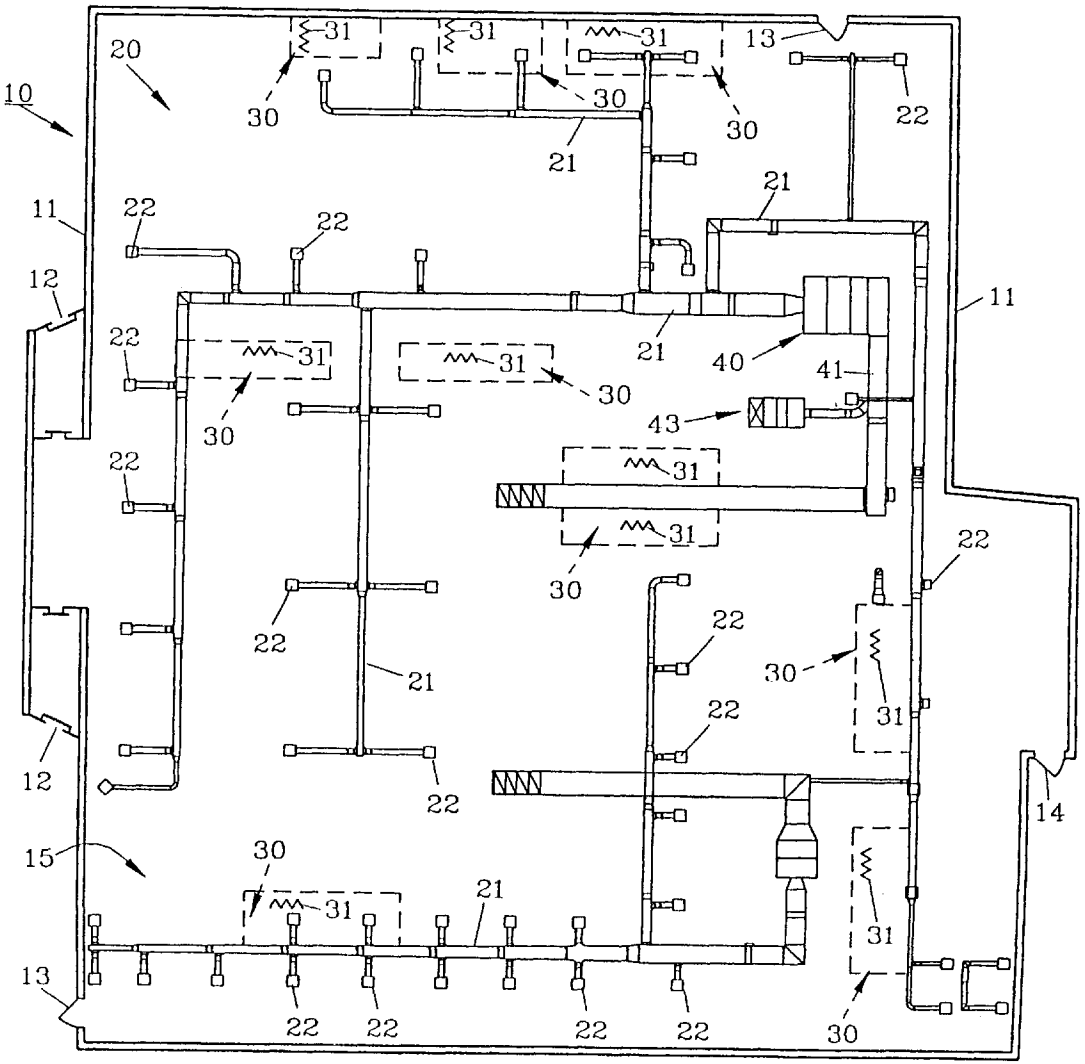
FIG. 1 illustrates a schematic layout of the preferred HVAC system in a typical grocery store utilizing the invention.

For a better understanding of the invention and its operation, turning now to the drawings, FIG. 1 demonstrates a schematic representation of a typical grocery store 10 with the roof removed to view the contents and components therein. As shown, outside wall 11 surrounds the interior of store 10 having front doors 12, auxiliary doors 13 and a rear door 14. Preferred HVAC system 20 includes conventional air ductwork 21 with diffusers 22 throughout for delivering conditioned air within store 10.

As is typical, grocery store 10 includes a series of refrigerated furniture cases 30 (shown in dotted lines) which may be both the low temperature (0° F.) and medium temperature (32–0° F.) types for displaying respectively, frozen foods, meat and dairy products. Nine such furniture cases are shown in FIG. 1 although the exact number will vary depending on the size of the store and the demands of its customers.

Figure 2:
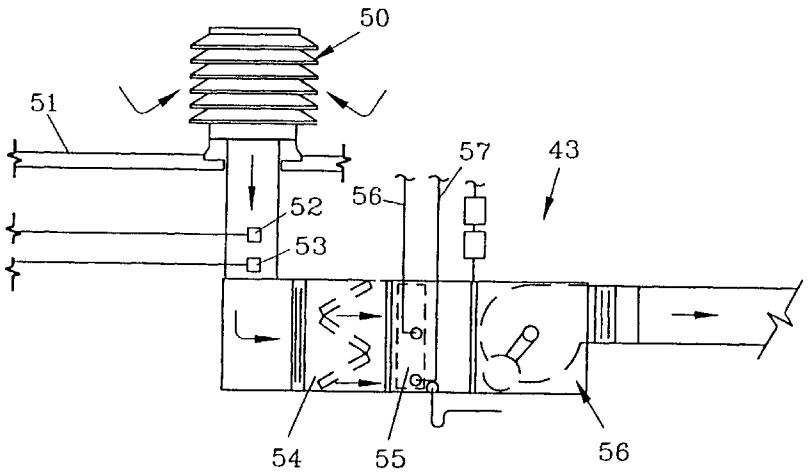
FIG. 2 shows the outside air roof intake for the HVAC system with the outside air treatment apparatus.

Each refrigerant furniture case 30 includes evaporator cooling coils 31 which are located proximate thereto, inside conditioned air space 15 of store 10. Conditioned air space 15 must therefore accommodate furniture evaporator coils 31 to prevent icing thereof as occurs when excess moisture is present in conditioned air space 15, shown schematically in FIG. 1. Standard main air handling unit 40 of preferred HVAC system 20 is connected by ductwork 41 to outside air treatment components 43 shown enlarged in FIG. 2. Fresh air passes into roof air intake 50 as seen in FIG. 2, and is directed through roof 51. Entering fresh air encounters standard electronic air temperature sensor 52 and standard electronic relative humidity sensor 53. The air is then directed through air filter 54 where it next passes through HVAC evaporator coil assembly 55. Evaporator coil assembly 55 removes moisture from the outside air before passage through main air handling unit 40. As would be understood, main air handling unit 40 then directs the conditioned air through ductwork 21 throughout store 10.

Figure 3:
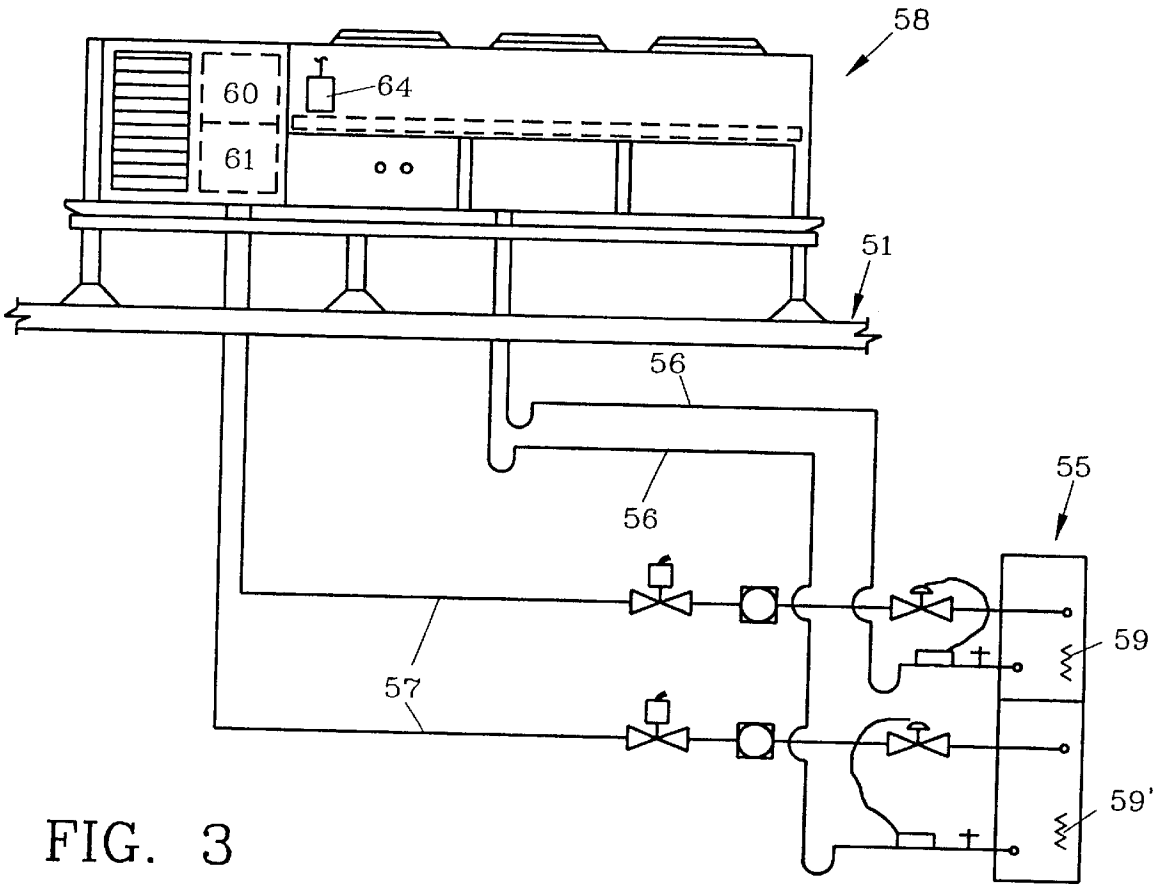
FIG. 3 demonstrates the roof mounted HVAC system condensing unit with attached compressors and cooling coils.

In FIG. 3, HVAC evaporator (cooling) coil assembly 55 is shown with suction line 56 and liquid line 57 passing through roof 51 and connected to custom pre-packaged condensing unit 58 thereon. Condensing unit 58 includes unequal size compressors 60, 61 in which compressor 60 is a 7½ horsepower compressor and compressor 61 is a 15 horsepower compressor. Compressors 60, 61 are matched with evaporator coil assembly 55 having intertwined unequal size coil circuits 59, 59' (FIG. 3). Dual piping allows each compressor 60, 61 its own intertwined evaporator circuit. Compressor 60 has approximately 50% of the horsepower capacity of compressor 61. Other compressors of unequal size and horsepower could likewise be utilized but compressors 60 and 61 are suitable for store 10, having about 38,000 square feet of conditioned air space with nine (9) refrigerant furniture cases and a nominal tonnage of 50–60 tons.

Figure 4:
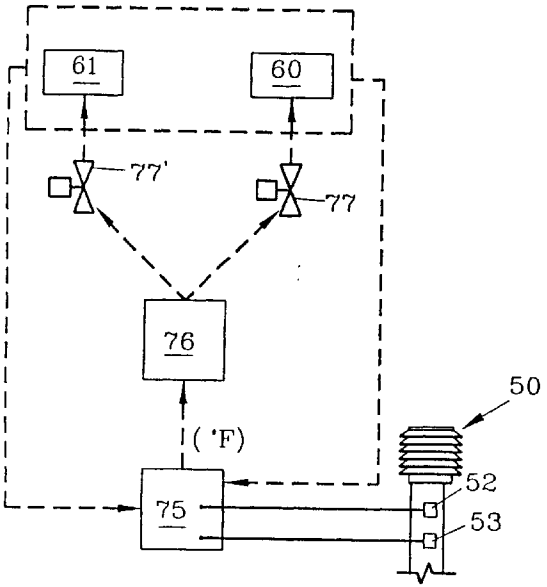
FIG. 4 depicts schematic electrical circuitry for controlling the moisture content of the outside air before it is brought into the conditioned air space.

Electrical schematic 70 seen in FIG. 4 illustrates the preferred electrical apparatus of the invention with standard electronic sensors 52, 53 in electrical communication with microprocessor 75 model #BEC-REFLECS as sold by CPC, Inc. of Kennesaw, Ga. which receives, for example in stage 2 conditions, a 75° F. dry bulb temperature measurement from sensor 52 and a 45% relative humidity measurement from sensor 53. Microprocessor 75 will then, by standard polynomial iterations, converge on a wet bulb temperature which is, for example 61° F. This 61° F. wet bulb temperature data is then transmitted to standard analog voltage output device 76 such as purchased from CPC, Inc. of Kennesaw, Ga. Analog voltage output device 76 then transmits a signal to conventional solenoid 77 which acts as an on/off switch for condensing unit 58 which stages compressors 60 as seen in FIG. 3. Condensing unit 58 then returns a neutral signal to microprocessor 75.

In Stage 3 conditions with a wet bulb temperature of, for example 63° F., the data is instead transmitted from standard analog voltage output device 76 to conventional solenoid 77' which acts as an on/off switch for condensing unit 58 to stage compressor 61. After staging a neutral signal is the return to microprocessor 75.

Stage 4 conditions would arise with a wet bulb temperature of, for example 68° F. Here, the data is transmitted from standard analog voltage output device 76 to solenoids 77 and 77' to stage both compressors 60 and 61 simultaneously. Thereafter condensing unit 58 then returns a neutral signal to microprocessor 75.

A built-in time delay circuit (not seen) delays the compressor stage change for 30 minutes to prevent unnecessary cycling of compressors 60, 61.

The wet bulb temperature is calculated with the known dry bulb temperature, relative humidity and altitude by using the standard algorithms as set forth in Chapter 6 of the 2001 *ASHRAE HANDBOOK FUNDAMENTALS* as published by the American Society of Heating, Refrigerating and Air-Conditioning Engineers, Inc. of Atlanta, Ga., incorporated herein by reference. The steps are as follows:

1. Calculate the vapor pressure and humidity ratio using the input dry bulb temperature at saturation (i.e. wet bulb=input dry bulb). *[6], [23]
2. Calculate the degree of saturation using the saturated humidity ratio (from Step 1) and the input relative humidity.*[14]
3. Calculate the actual humidity ratio at input conditions using the saturated humidity ratio corrected to the degree of saturation from Step 2. This is the benchmark. *[12]
4. Set the first trial wet bulb equal to 5° F.
5. Calculate the vapor pressure and humidity ratio using the trial wet bulb temperature at saturation (i.e. dry bulb=trial wet bulb). *[6], [23]
6. Calculate the trial humidity ratio using the saturated humidity ratio from Step 5 along with the input dry bulb temperature and the trial wet bulb temperature. *[35]

7. Compare the trial humidity ratio to the benchmark. If it is too low, add an appropriate increment (e.g. 5°) to the trial wet bulb and repeat Steps 6 and 7. If it is too high, deduct the last increment and add a smaller increment and repeat Steps 6 and 7. The current trial wet bulb temperature is the correct answer when the comparison produces a 0.001 error or less.

[ ] are algorithm numbers from the 2001 *ASHRAE Fundamentals Handbook*, SUPRA

Using BASIC II program language, computer instructions are for calculating the wet bulb temperature with a dry bulb temperature and relative humidity input is as follows:

Program "WET.BULB.BAS, Written by W. E. Clark in August 2001

Calculates wet bulb temperature when dry bulb temperature, relative humidity and altitude are input. Based on formulas #6, #14, #23 and #35 in the 2001 *ASHRAE Fundamentals*, Chapter 6.

```
' ******************** Main Program Start ************************
FreshStart:
CLEAR
SCREEN 0
COLOR 14, 1
CLS
ON KEY(1) GOSUB HotKey
KEY(1) ON
ON KEY(5) GOSUB GoHome
KEY(5) ON
ON KEY(9) GOSUB Calc
KEY(9) ON
GOSUB FieldRead          'Get the input data field locations
StartHere:
GOSUB Labels
GOSUB InputScreen
GOSUB DataInput
' ********************** Main Program Finish ************************
' ************** Read in all on the field definitions *************
FieldRead:
    'Field definitions: start row, start column, end column, format,
    'std. message, error message, lower level, upper level, screen #
FOR a = 1 TO 3
    READ fsr%(a), fsc%(a), fec%(a), ff$(a), fm$(a)
    READ fem$(a), fll(a), ful(a)
NEXT a
RETURN
    ' ******** Wet Bulb Screen Input Fields ************************
    'Dry Bulb Temperature field - indat$(1)
DATA 10,55,59,###.#,"Enter the Dry Bulb Temperature - 32 to 120 Degrees F."
DATA "THAT IS NOT A VALID NUMBER!",32,120
    'Relative Humidity field - indat$(2)
DATA 12,55,59,###.#,"Enter the Relative Humidity - 0% to 100%"
DATA "THAT IS NOT A VALID NUMBER!",0,100
    'Altitude field - indat$(3)
DATA 14,55,59,#####
DATA "Enter the Altitude in feet above sea level - 0 to 15000 Ft."
DATA "THAT IS NOT A VALID NUMBER!",0,15000
    ' ******** Wet Bulb Screen Input Fields ********************
    ' ************** Read in the special characters ******************************
Labels:
degree$ = STRING$(1, 248)          'Do the degree fahrenheit label
scale$ = "F"
lbrack$ = STRING$(1, 40)
rbrack$ = STRING$(1, 41)
fahr.x$ = degree$ + scale$          'Degrees F without parenthesis
fahr$ = lbrack$ + degree$ + scale$ + rbrack$
RETURN
    ' ************** Read in the special characters ********************
    ' ***************** Print out the input screen ******************
InputScreen:
    'Heading
LOCATE 5, 1
xxx$ = "WITT WET BULB TEMPERATURE CALCULATOR"
GOSUB Center
PRINT head$
    'Input Labels
LOCATE 10, 21: PRINT USING"      Dry Bulb Temperature [ ][ ]="; fahr$
LOCATE 12, 21:      PRINT"      Relative Humidity (%) = "
LOCATE 14, 21:      PRINT "Altitude (Feet Above Sea Level) = "
FOR x = 1 TO 3
    LOCATE fsr%(x), fsc%(x)
    PRINT indat$(x)
```

-continued

```
NEXT x
msg$ = "Press [Enter], [up cursor] or [down cursor] to enter data into program"
msgrow = 21
GOSUB Message
msg$ = "[F1 = Escape] [F5 = Exit] [F9 = Calculate]"
msgrow = 23
GOSUB Message
RETURN
    ' ***************** Print out the input screen ******************
    '************************** Get the data ************************
DataInput:
    cdat = 1            'Initialize current data
Locator:
    b$ = ""             'Zero the input accumulator
msgrow = 19
msg$ = fin$(cdat)
GOSUB Message
LOCATE fsr%(cdat), fsc%(cdat), 1, 1, 10
CurseOn:
LOCATE , , 1, 1, 10             'Turn on 10 pixel cursor
Wait2: a$ = INKEY$: IF a$ = "" THEN GOTO Wait2 'Get the keyboard input
col% = POS(n)                   'Save the position
LOCATE fsr%(cdat), col%             'Turn the cursor off
code% = 0                       'Clear scan code storage
IF LEN(a$) = 2 THEN code% = ASC(RIGHT$(a$, 1)) 'Get extended scan code
    'Cursors work only if current data block has good data.
    '[Enter] same as down cursor.
IF a$ = CHR$(13) THEN code% = 80        '<CR> trap same as down cursor
SELECT CASE code%
    CASE 72                 'Up cursor input
      LOCATE , , 0            'Turn the cursor off
      GOSUB DataTrap            'Data trap and print routine
      SELECT CASE cdat
        CASE IS = 1
          cdat = 3
        CASE ELSE
          cdat = cdat - 1   'Move up one block
    END SELECT
      GOTO Locator
    CASE 80                 'Down cursor input
      LOCATE , , 0            'Turn the cursor off
      GOSUB DataTrap            'Data trap and print routine
      SELECT CASE cdat
        CASE IS = 3
          cdat = 1
        CASE ELSE
          cdat = cdat + 1  'Move down one or more blocks
      END SELECT
      GOTO Locator
END SELECT
IF a$ = CHR$(8) THEN                'Trap backspace
    IF b$ = "" THEN GOTO CurseOn  'Nothing left? Go get new data
    GOTO BackSpace              'Backspace service routine
END IF
'SELECT CASE ASC(a$)            'Check for valid characters.
' CASE 48 TO 57, 65 TO 90, 32, 46   'Numbers, Caps, space, dot OK
' CASE ELSE
'   BEEP
'   GOTO CurseOn
'END SELECT
IF (LEN(b$) + LEN(a$)) > (fec%(cdat) – fsc%(cdat) + 1) THEN
    BEEP
    GOTO CurseOn                'Sound error when field is full
END IF
PRINT a$;
b$ = b$ + a$                    'Update block data
GOTO CurseOn
    '************************** Get the data ************************
    '***************** Data Trap and Print Routine **********************
DataTrap:
IF b$ = "" THEN b$ = indat$(cdat)    'If null input, use existing data
indat$(cdat) = b$                   'Update Indat$
    ' *********** Check it out
SELECT CASE cdat
    CASE IS = 1, 2, 3
      IF VAL(b,$) < fll(cdat) OR VAL(b$) > ful(cdat) THEN
        GOSUB BadData
        RETURN Locator
      END IF
```

-continued

```
END SELECT
SELECT CASE cdat
    CASE IS = 1
      dry.bulb = VAL(b$)
    CASE IS = 2
      rh.pct = VAL(b$)
      IF b$ = "" THEN indat$(2) = "0"
      GOSUB InputScreen
    CASE IS = 3
      altitude = VAL(b$)
      IF b$ = "" THEN indat$(3) = "0"
      GOSUB InputScreen
END SELECT
                                    'Calculate spaces needed, if any
    mt.field = fec%(cdat) - fsc%(cdat) + 1 - LEN(indat$(cdat))
    blank$ = SPACE$(mt.field)
    LOCATE fsr%(cdat), fsc%(cdat)
b$ = ""
RETURN
    '****************** Data Trap and Print **********************
    '******************* F1 Hot Key to escape looping ***************
HotKey:
RESTORE
RETURN FreshStart
    ' ******************* F1 Hot Key to escape looping ***************
    ' ******************* F5 Exit Routine ***************
GoHome:
CLS
END
RETURN
    '******************* F5 Exit Routine ***************
    ' ************* F9 Enter to Calculations ************************
Calc:
LOCATE , , 0                        'Turn the cursor off
FOR cdat = 1 TO 3
    LOCATE fsr%(cdat), fsc%(cdat)     'Display data actually entered
    PRINT "    "                      ' into program.
    LOCATE fsr%(cdat), fsc%(cdat)
    PRINT indat$(cdat)
NEXT cdat
RETURN Calculations
    ' ************* F9 Enter to Calculations ************************
    '*************** Calculate the Wet Bulb *************************
Calculations:
KEY(9) ON
rh.decimal = rh.pct / 100
pbar = 29.92 * (1 - 6.8753E-06 * altitude) ^ 5.2559
wet.bulb = 1      'dry.bulb - 25          'Starting values
adder = 5
temp = dry.bulb
GOSUB VaporPressure                 'Calculate the vapor pressure,
                                  ' humidity ratio @ saturation &
                                  ' degree of saturation based on the
                                  ' dry bulb @ saturation and input RH
                                  ' - - to be used as the standard
hum.ratio.actual = hum.ratio.sat * deg.sat
    ' Start brute force convergence routine. Calculate humidity ratio at
    ' saturated wet bulb (trial value). Compare this humidity ratio to the
    ' hum.ratio.actual calculated above. Adjust wet bulb as required until
    ' the two humidity ratios are equal within .001.
Iterate:
temp = wet.bulb
GOSUB VaporPressure
x = (1093 - .556 * wet.bulb) * hum.ratio.sat - .24 * (dry.bulb - wet.bulb)
y = 1093 + .444 * dry.bulb - wet.bulb
hum.ratio.test = x / y
gr.per.lb = (hwn.ratio.actual - hum.ratio.test) * 7000 'How far off are we?
    SELECT CASE gr.per.lb
      CASE -.001 TO .001            'We're there
        GOTO Finish.Up
      CASE IS < 0                 'We went too far
        wet.bulb = wet.bulb - adder
        adder = adder * .2
      CASE IS > 0                 'Not far enough
        wet.bulb = wet.bulb + adder
    END SELECT
GOTO Iterate
    '*************** Calculate the Wet Bulb *************************
    '*************** Print the answer ******************************
```

-continued

```
Finish.Up:
LOCATE 19, 1: PRINT SPACE$(79)
LOCATE 21, 1: PRINT SPACE$(79)
msgrow = 21
msg$ = "Press any key to continue"
GOSUB Message
LOCATE , , 0                    'Turn the cursor off
LOCATE 17, 27
PRINT USING "Wet Bulb Temperature \ \ = ##.#"; fahr$; wet.bulb
Wait1: a$ = INKEY$: IF a$ = "" THEN GOTO Wait1
LOCATE 17, 1: PRINT SPACE$(79)
msg$ = "Press [Enter], [up cursor] or [down cursor] to enter data into program"
msgrow = 21
GOSUB Message
GOTO DataInput
        '**************** Print the answer ******************************
    '***** 'Calculate saturated vapor pressure & degree of saturation ***
VaporPressure:
Rankine = temp + 459.67
c8 = -10440.397#
c9 = -11.29465#
c10 = -.027022355#
c11 = .00001289036#
c12 = -.0000000024780681#
c13 = 6.5459673#
    ' Calculate natural log of saturated pressure in psia
ln.press = c8/Rankine + c9 + c10 * Rankine^2 + c12 * Rankine^3 + c13 *
LOG(Rankine)
    ' Calculate e^x then inches Hg. - vapor pressure @ saturation
vap.press.sat = 2.718282 ^ ln.press * 2.036
    ' Calculate the humidity ratio @ saturation
hum.ratio.sat = .62198 * vap.press.sat / (pbar - vap.press.sat)
    ' Calculate degree of saturation
deg.sat = rh.decimal / (1 + (1 - rh.decimal) * hum.ratio.sat / .62198)
RETURN
    ' ***** 'Calculate saturated vapor pressure & degree of saturation ***
      ' ****************** Backspace Service Routine ***********************
BackSpace:
col% = POS(n)                   'Save cursor position
b$ = LEFT$(b$, (LEN(b$) - 1))     'Shorten combined string by one
LOCATE fsr%(cdat), fsc%(cdat)         'Go to the field beginning
PRINT SPACE$(fec%(cdat) - fsc%(cdat) + 1)   'Blank the block
LOCATE fsr%(cdat), fsc%(cdat)               'Relocate
PRINT b$                            'Print what's left
LOCATE fsr%(cdat), (col% - 1)'              'Go to space after b$
GOTO CurseOn
    ' ****************** Backspace Service Routine ***********************
    '***************** Bad data error routine *********************
BadData:
BEEP
msg$ = fem$(cdat)
LOCATE , , 0                        'Turn the cursor off
warning = 1
ON KEY(2) GOSUB GoAhead
KEY(2) ON
Flasher:
    IF warning = 1 THEN
      LOCATE 18, 1: PRINT SPACE$(79)
      LOCATE 19, 1: PRINT SPACE$(79)
      warning = 0
      FOR delay = 1 TO 400 STEP .01: wec = 9.9 ^ 26: NEXT delay
      GOTO Flasher
ELSE
      spacer = CINT((81 - LEN(msg$)) / 2)       'Get the leading spaces
      LOCATE 18, spacer
      PRINT msg$                  'Print it
      LOCATE 19,28
      PRINT "Press key F2 to continue"
      warning = 1
      FOR delay = 1 TO 800 STEP .01: wec = 9.9 ^ 26: NEXT delay
      GOTO Flasher
    END IF
GoAhead:
LOCATE 18, 1: PRINT SPACE$(79)
LOCATE 19, 1: PRINT SPACE$(79)
blank$ = SPACE$(fec%(cdat) - fsc%(cdat) + 1)    'Figure the blanks needed
LOCATE fsr%(cdat), fsc%(cdat)               'Go to the field start
PRINT blank$                            'Blank the field
b$ = ""                             'Zero out the entry
```

-continued

```
RETURN Locator                          'Try again
    '**************** Bad data error routine *********************
    '*************** Standard instructions **************************
Message:
LOCATE , , 0                    'Turn the cursor off
LOCATE msgrow, 1: PRINT SPACE$(79)        'Locate and blank the message field
LOCATE msgrow, 1                    'Relocate
msg$ = (SPACE$((79 - LEN(msg$)) / 2) + msg$)    'Center it
COLOR 15, 1                     'Highlight it
PRINT msg$                      'Print it
COLOR 14, 1                     'Normal color
RETURN
    ' *************** Standard instructions **************************
    '**************** Title centering routine *********************
Center:
head$ = (SPACE$((82 - LEN(xxx$)) / 2) + xxx$)
RETURN
    '**************** Title centering routine *********************
                        -END OF PROGRAM-
```

In a typical control sequence, as outside air enters air intake 50, sensors 52, 53 record, respectively the sensible air and relative humidity temperatures. These temperatures are then inputted to microprocessor 75. Microprocessor 75 receives the sensed temperatures and calculates a wet bulb temperature by conventional iterating of a standard polynomial. This process of sensing, inputting and calculating is repeated at set time intervals (preferably every 6 seconds), to upgrade the converged wet bulb temperature. That wet bulb temperature value or resultant then triggers an analog output for each of the four compressor stages below.

Stage 1: both compressors off;

Stage 2: the smaller compressor on and the larger off;

Stage 3: the smaller compressor off and the larger on; and

Stage 4: both compressors on.

Analog output device 76 provides a 120 control voltage to solenoid valves 77, 77' of evaporator coil assembly 55 of HVAC system 20, allowing refrigerant to flow through liquid lines 56 which will activate low pressure switch 64 at condensing unit 58, causing compressors 60/61 and fans of HVAC system 20 to cycle. As mentioned, there is a programmed 30 minute time delay to keep compressors 60, 61 from short cycling as the wet bulb temperature changes the operation of compressors 60, 61 from one stage to another. That is, the same wet bulb temperature must be present in another compressor stage wet bulb temperature range for a minimum of 30 minutes before a compressor stage is activated or deactivated.

The set points for operation of each of the compressors is determined by trial and error computer calculations in which a general wet bulb temperature is matched against a general compressor capacity stage. A stage is determined operational between an entering wet bulb temperature that produces a 32° F. (suction) temperature of the evaporator coil assembly 55 and the entering wet bulb temperature that produces 50° F. (saturated) leaving air temperature.

The illustrations and examples provided herein are for explanatory purposes and are not intended to limit the scope of the appended claims.

We claim:

1. A method for conditioning air prior to entry into a conditioned air space utilizing temperature and relative humidity sensors and means to compress a refrigerant, said method comprising the steps of:

a) sensing the temperature of the outside air;

b) sensing the relative humidity of the outside air;

c) processing the temperature and relative humidity sensed to obtain a resultant; and d) staging the compressor means accordingly to the resultant to remove moisture from the air prior to its entry into the conditioned air space.

2. The method of claim 1 wherein sensing the temperature comprises the step of measuring the sensible temperature of the outside air with an electronic sensor.

3. The method of claim 1 wherein sensing the relative humidity comprises the step of measuring the relative humidity electronically.

4. The method of claim 1 wherein processing the temperature and relative humidity resultant comprises the step of iterating a polynomial to converge a wet bulb temperature.

5. The method of claim 4 further comprising the step of comparing the converged wet bulb temperature to pre-set points of the compressor means.

6. The method of claim 4 wherein processing the resultant comprises the step of utilizing a microprocessor.

7. The method of claim 4 wherein iterating a polynomial comprises the step of iterating a standard polynomial.

8. The method of claim 1 wherein staging the compressor means comprises the step of staging a plurality of unequal capacity compressors.

9. The method of claim 8 wherein staging unequal capacity compressors comprises the step of staging two unequal capacity compressors.

10. The method of claim 9 wherein staging two unequal capacity compressors comprises the step of staging a first compressor having approximately one half the capacity of the second compressor.

11. The method of claim 8 wherein staging the compressors comprises staging a pair of unequal capacity compressors in four stages.

12. The method of claim 11 wherein staging the pair of compressors comprises the step of staging the compressors wherein:

In stage 1 wherein both compressors are off;

In stage 2 wherein the first compressor is on and the second compressor is off;

In stage 3 wherein the first compressor is off and the second compressor is on; and In stage 4 wherein both compressors are on.

13. The method of claim 11 wherein during the second stage the first compressor is activated at a wet bulb temperature of about 57° F.

14. The method of claim 11 wherein during the third stage the second compressor is activated at a wet bulb temperature of about 61° F.

15. The method of claim 11 wherein during the fourth stage the first compressor is activated at a wet bulb temperature of about 67° F. and the second compressor is activated at a wet bulb temperature of about 67° F.

16. In an HVAC system where the sensible temperature of the outside air is measured with an electronic sensor before it enters the conditioned air space and the relative humidity is measured by an electronic device before it enters the conditioned air space, the improvement comprising: a microprocessor in connection with said electronic sensor and with said electronic relative humidity device, said microprocessor for calculating the wet bulb temperature utilizing the sensible air temperature measurement and the humidity measurement, a plurality of unequal size compressors, said compressors staged to remove moisture from the outside air, said compressors in communication with said microprocessor.

17. The HVAC system of claim 16 wherein said compressors operate in four stages.

18. The HVAC system of claim 16 wherein said unequal size compressors comprises two compressors with the smaller compressor being approximately 50% the capacity of the larger compressor.

19. A method for conditioning air prior to entry into a conditioned air space utilizing temperature and relative humidity sensors and a means to compress a refrigerant, said refrigerant compressing means comprising at least two unequal capacity compressors, said method comprising the steps of:

a) sensing the temperature of the outside air;

b) sensing the relative humidity of the outside air;

c) processing the temperature and relative humidity sensed to obtain a resultant; and d) staging the compressing means accordingly to the resultant to remove moisture from the air prior to its entry into the conditioned air space in four stages wherein:

In stage 1: both compressors are off;

In stage 2: the first compressor is on and the second compressor is off;

In stage 3: the first compressor is off and the second compressor is on; and

In stage 4: both compressors are on.

20. The method of claim 19 wherein staging the compressing means comprises the step of staging at least two compressors which differ in capacity by about 50%.

* * * * *